United States Patent [19]

Hada et al.

[11] Patent Number: 5,003,228

[45] Date of Patent: Mar. 26, 1991

[54] PLASMA DISPLAY APPARATUS

[75] Inventors: Hiroshi Hada; Yoshihisa Hosono, both of Tokyo, Japan

[73] Assignee: NEC Corporation, Japan

[21] Appl. No.: 271,937

[22] Filed: Nov. 16, 1988

[30] Foreign Application Priority Data

Nov. 16, 1987 [JP] Japan ..... 62-289904

[51] Int. Cl.[5] ..... G09G 3/10

[52] U.S. Cl. ..... 315/169.4; 340/771; 340/776

[58] Field of Search ..... 315/169.4; 340/771, 340/776

[56] References Cited

U.S. PATENT DOCUMENTS 3,869,644 3/1975 Yano et al. ..... 315/169.4

4,692,665 9/1987 Sakuma ..... 315/169.4

4,859,910 8/1989 Iwakawa et al. ..... 315/169.4 X

*Primary Examiner*—Eugene R. LaRoche

*Assistant Examiner*—Do Hyun Yoo

*Attorney, Agent, or Firm*—Laff Whitesel Conte & Saret

[57] ABSTRACT

The invention provides voltage potential differences for selectively discharging cells in a plasma display device, with greater brightness and reduced power consumption. The plasma display device has orthogonally related electrodes sealed in an atmosphere of neon gas. When a predetermined potential is applied between two intersecting electrodes, the neon gas glows at the intersection. The predetermined potential is achieved by applying two pulse trains which have opposite phases and therefore oppositely going voltage polarities. The difference in the oppositely going peak voltages of the two pulse trains provides a firing potential at the selected intersection. To decrease the voltage causing an erroneous discharge, a short period of an extinction mode is introduced before an address mode. In another embodiment, to reduce power consumption, the cell at the intersection is fired at a high potential during an address mode and thereafter held in a glowing state by a greatly reduced voltage. Another embodiment produces a similar result by changing the frequency of driving pulses in the firing and the holding modes.

5 Claims, 5 Drawing Sheets

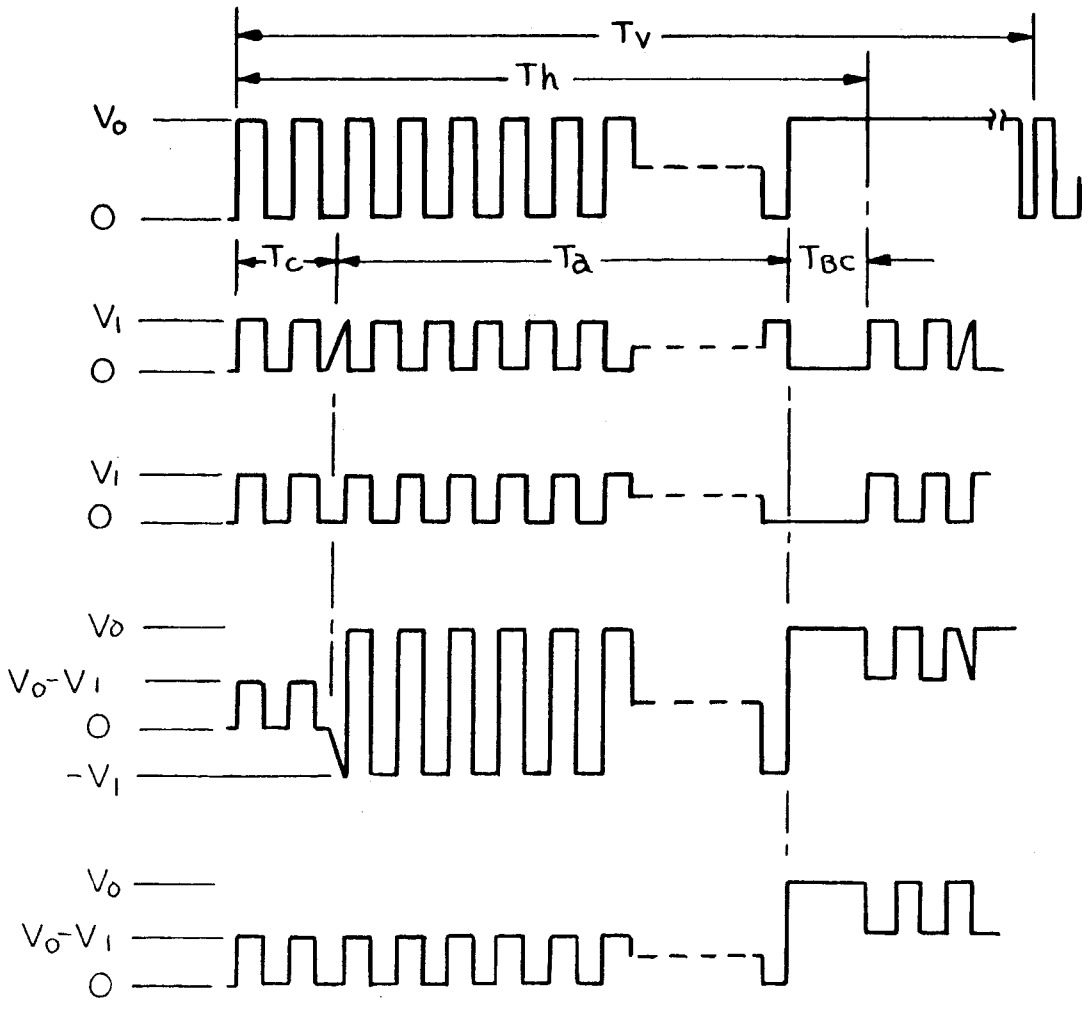
FIG.4A 1ST ROW
FIG.4B m-th COLUMN
FIG.4C n-th COLUMN
FIG.4D 1ST ROW mth COLUMN CELL
FIG.4E 1ST ROW nth COLUMN CELL

PLASMA DISPLAY APPARATUS

BACKGROUND OF THE INVENTION

This invention relates to a plasma display apparatus and more particulary to a drive of AC refresh-type plasma display panel.

A typical example of a conventional AC refresh-type plasma display panel (PDP) to be used in the present invention includes two glass plates having electrode groups which are coated with a dielectric layer. The two glass plates are arranged in a manner which makes electrodes of respective glass plates opposed to each other. Electrodes on each glass plate intersect each other perpendicularly to form a matrix display type. The glass plates are sealed air-tightly with glass frits. Neon gas is filled in the sealed space so as to exist between the glass plates.

When the driving circuit applies a pulsed voltage to electrodes on only one glass plate while maintaining the electrodes on the other glass plate at potential zero, discharge occurs between electrodes to display an image. The voltage discharged at the cell which is the most easy to discharge within the PDP is defined as the minimum unilateral discharge voltage (VDmin). The voltage discharged at the cell which is the most unlikely to discharge within the PDP is defined as the maximum unilateral discharge voltage (VDmax). If electrodes on one glass plate of the PDP have a first pulse train applied thereto with a high voltage (V0) which is higher than VDmin but lower than VDmax while the electrodes on the other glass plate have a second pulse train applied thereto with a low voltage (V1) which has a phase same as or opposite to the first pulse train, the discharge does not occur when the relation holds; $VDmin > |V0| - |V1|$ and discharge occurs when the relation holds; $VDmax < |V0| + |V1|$.

U.S. Pat. No. 3,869,644 issued on Mar. 4, 1975 discloses a phase-select method using the above condition as one example of the prior art AC refresh-type driving circuits for plasma display panels (PDP). In this prior art driving circuit, a first pulse train of high voltage is applied to scanning electrodes on one glass plate in a time division mode. A second pulse train of low voltage, having the phase opposite to the phase of the first pulse train, is applied to selected data electrodes of selected cells, on the other glass plate. In addition, a third pulse train of low voltage having the phase which is the same as the phase of the first pulse train is applied to remaining data electrodes of non-selected cells so as not to discharge the non-selected cells, thereby securing a stable operation.

In this prior art driving circuit, however, driving circuits are electrically connected via stray capacities between adjacent data electrodes provided on the substrate of PDP. When the adjacent data electrodes are driven for discharging and non-discharging concurrently, the power consumption of the driving circuits for the adjacent data electrodes becomes maximum. Although the brightness of an AC refresh-type PDP is determined by the number of pulses contained in a unit time, the larger the number of pulses becomes, the larger the power consumption of the driving circuits becomes. Thus the restrictions on the driving frequency present a formidable obstacle in obtaining sufficient brightness.

The prior art driving circuit is further detrimental in that if there is a mismatch in time on high frequency pulses between voltages applied to the scanning electrodes and the data electrodes, the range of the driving voltage becomes narrow.

Moreover, if transparent electrodes are used for data electrodes, a distributed constant circuit is formed via stray capacity between the transparent electrodes. As the waveforms and voltages at a tip end of the transparent electrodes differ from the waveforms and voltages at an input end, the brightness fluctuates unevenly. This also causes a delay in time and changes in voltage between the first pulse train for the scanning side and the second and third pulse trains for the data side. The range of driving voltage inconveniently becomes narrower.

SUMMARY OF THE INVENTION

It is, therefore, an object of this invention to provide a plasma display apparatus which display an image with a high level of brightness, small power consumption and a larger operating range.

It is another object of this invention to provide a driving method of plasma display panels for obtaining an improved brightness, power consumption and operating range.

According to this invention, the driving pulses applied to either selected cells or non-selected cells during one scanning cycle includes a period of an address mode pulses and a period of an extinction mode pulses before the address mode pulse period. In the address mode period, a potential difference larger than $VD_{max}$ is applied by the address mode pulses to discharge the selected cells while a potential difference smaller than $VD_{min}$ is applied to not discharge the non-selected cells. In the extinction mode period, on the other hand, the potential difference smaller than $VD_{min}$ is applied by the extinction mode pulses not to discharge both the selected cells and non-selected cells. In another embodiment, the one scanning cycle further includes a period of a hold mode period after the address mode period. In this hold mode period, the potential difference applied to both the selected cells and the non-selected cells is reduced, but the potential difference has the same amplitude which is such that the selected cells can continue in the discharge stage while the non-selected cells requires enough time to start a discharge.

The time delay may vary depending on the amplitude of the potential difference, but generally becmes 5 micro sec. or more in the AC refresh-type method. The response to a discharge is extremely fast, once it is started, an is less than 100 nano sec. due to ions and electrons filled in the selected cells. The present invention uses this phenomenon of discharge jitter. More particularly, the address mode can be obtained by applying pulse train of low voltage to a data electrode with the phase opposite to or identical with the pulse train of high voltage applied to a scanning electrode. The extinction mode can be obtained by applying several pulses of low voltage to all data electrodes with the phase identical with the pulse train of the high voltage applied to the scanning electrode. The hold mode can be obtained by applying a DC voltage to the data electrode.

BRIEF DESCRIPTION OF THE DRAWINGS

FIGS. 4A to 4E are waveform diagrams showing a relationship between the voltages applied to a scanning electrode and data electrodes, according to a third preferred embodiment of this invention.

DESCRIPTION OF PREFERRED EMBODIMENTS

Figures 1A, 1B, 1C, 1D, 1E:
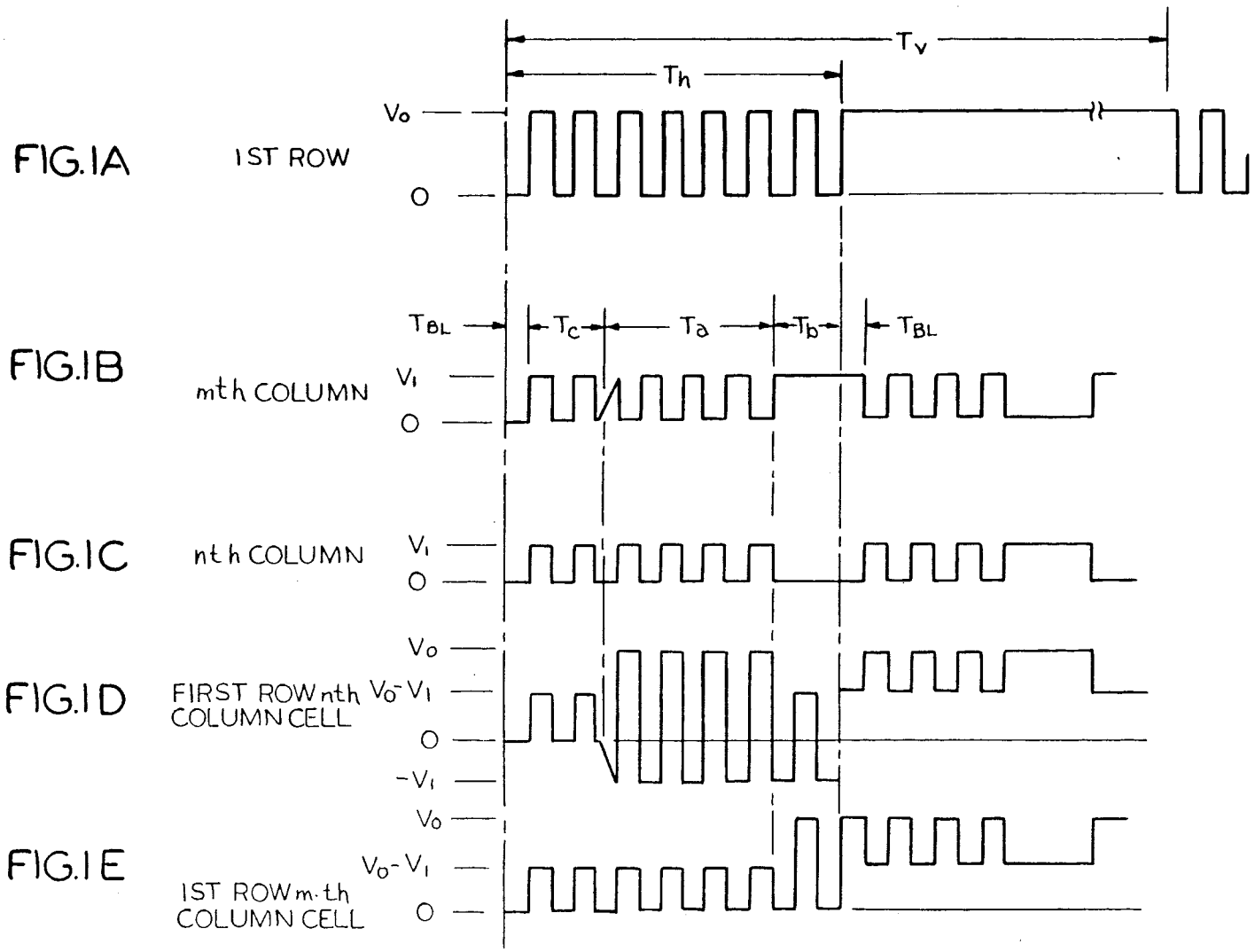
FIGS. 1A to 1E are waveform diagrams showing a relationship between the voltages applied to a scanning electrode and data electrodes, according to a first preferred embodiment of this invention.

Referring to FIG. 1, while a first pulse train of peak voltage $V_0$ is applied to the first scanning or row electrode for one scanning period Th, as shown in FIG. 1A, a second pulse train of peak voltage $V_1$ is applied to the mth data or column electrode for a period Ta which is shorter than the period Th as shown in FIG. 1B. Following the pulse train for the period Ta, a direct current voltage is applied to the mth column electrode for a period Tb as shown in FIG. 1B. Preceding the pulse train for the period Ta, a third pulse train peak voltage $V_1$ is applied to the mth column electrode for a period Tc which is shorter than the period Ta as shown in FIG. 1B. The period represented by the letter $T_{BL}$ in FIG. 1 is a blanking period. Thus the sum of the periods, $Ta+Tb+Tc+T_{BL}$, indicates the one scanning period Th.

As is shown in FIG. 1B, the second pulse train has a phase which is opposite to the phase of the first pulse train so as to produce a first pulsing potential difference shown in FIG. 1D. This first potential difference is larger than the firing voltage of the selected cell which is formed at the intersection of the first row electrode and the mth column electrode. The third pulse train has a phase which is identical with the phase of the first pulse train, as shown in FIG. 1B, so as to produce a second pulsing potential difference shown in FIG. 1D. This second potential difference is smaller than a holding voltage of a selected cell which is formed at the intersection of the first row electrode and the mth column electrode. When the nth column electrode is associated with a non-selected cell which is not to be discharged, a fourth pulse train of peak voltage $V_1$ is applied to the nth column electrode for the periods Ta and Tc with a phase which is identical with the phase of the first pulse train as shown in FIG. 1C. During the period Tb, the nth columnm electrode also has a direct current voltage applied thereto. FIG. 1E shows the potential difference applied to a non-selected cell formed at the intersection of the first row electrode with the nth column electrode.

The operation during the period Ta, in the one scanning period Th, is identical to the operation disclosed in the aforementioned U.S. Pat. No. 3,869,644. The period Ta is defined herein as an address mode. The potential difference $V_0$, which is applied to the selected cells and non-selected cells during the period Tb in the one scanning period Th, are completely identical to each other, as shown in FIGS. 1D and 1E. This period is referred herein as a hold mode.

At the address mode, if the relations set forth below hold, the selected cells which are to glow are discharged and the non-selected cells which are not to glow are not discharged;

$$VDmax < |V1| + |V0| \quad (1)$$

$$VDmin > |V0| - |V1| \quad (2)$$

In the hold mode, the potential difference $V_0$ is applied irrespective of whether the cells are to glow or not to glow. The cells maintain the state which is created at the address mode which preceded the hold mode.

More particularly, as the selected cell is discharged at the period Ta, the selected cell is filled with charged particles generated by the discharge; thus, the following discharge is easily actuated even in the hold mode where the potential difference which is applied is lower than the potential difference which is applied in the address mode.

Since the non-selected cell is not discharged in the address mode period Ta, the non-selected cell is not filled with charged particles. Therefore, it takes a certain time before the non-selected cell starts to discharge in the subsequent period Tb, with the potential difference $V_0$. Accordingly, if a suitable period is selected, for instance, at 20 micro second or less for the period Tb, it is possible to determine the voltage which will not start a discharge at the hold mode.

Next, the explanation will be given on the period Tc in FIG. 1. This period Tc is referred herein as an extinction mode. Since the same pulse is applied to all the column electrodes in this period, the influences of the stray capacitance between the colunm electrodes can be neglected. And thus the difference between voltage and waveform at the output of the driving circuit and voltages and waveform at the tip portions of the electrodes become small. Furthermore, since all the discharge cells stop discharge in this period Tc, pick-up of discharge from the adjacent cells is eliminated. After all, when compared with the conventional driving system, the cells which should discharge in the address mode in the period Ta, an initial discharge is a little bit difficult to occur due to the extinction mode of the period Tc. However, since discharge stops completely in the period Tc, the non-selected cells do not pick up discharge from the adjacent selected cells. In other words, the voltage which causes erroneous discharge becomes higher in the aspect of display so that a driving voltage can be made higher. Generally, when the pulse frequency is increased, it becomes more difficult to eliminate the time deviation between the pulse voltages applied to row and column electrodes due to the speed of the switching operation generating the output state of the driving voltage, and the voltage causing the erroneous discharge becomes lower. In accordance with the present invention, however, although a voltage for the erroneous discharge becomes higher due to the existance of the extinction mode for the period Tc and thus display brightness can be improved.

Figures 2A, 2B, 2C, 2D, 2E:
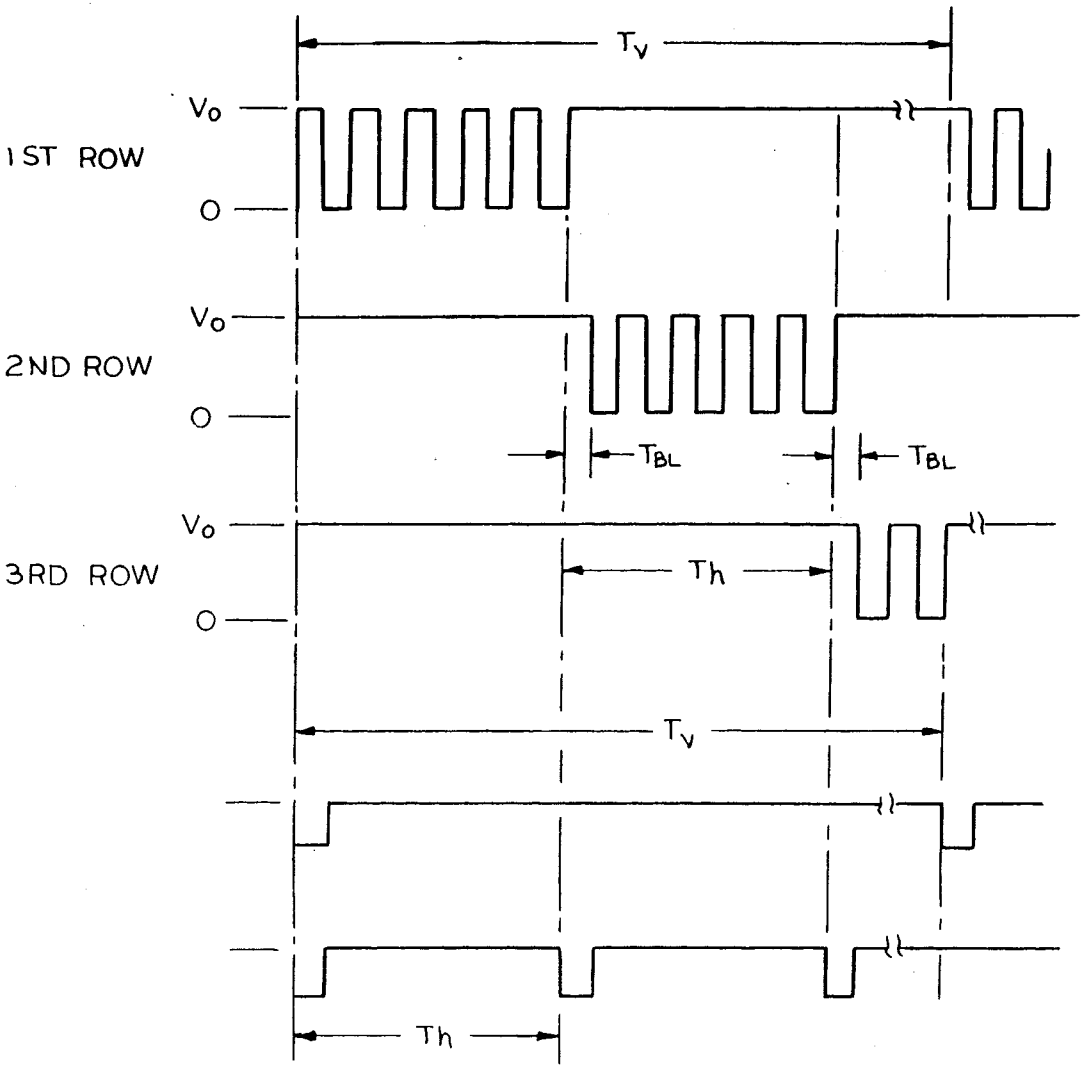
FIGS. 2A to 2E are waveform diagrams showing a pulse train applied at scanning electrodes in a time-division mode.

Needless to say, in order to drive a conventional plasma display panel, the scanning electrode group is selected for the period $T_h$ with the horizontal synchronizing signals shown in FIG. 2E. The first electrodes have a pulse train applied thereto with the peal value of $V_0$ shown in FIG. 2A. After a certain period (blanking period), the second scanning electrode is selected. The pulse voltage having the peak value of $V_0$ is applied to the second scanning electrode only for the period $T_h$. (Refer to FIG. 2B.) The third scanning electrode has a pulsed voltage applied thereto after a pulsed voltage is applied to the second scanning electrode. This operation is repeated sequentially until the time when vertical snychronizing signal arrives or for the period $T_v$. The circuit then returns to the state which allows a selection of the first scanning electrode when the vertical synchronizing signal arrives.

According to this invention, each of the scanning electrodes is sequentially scanned with horizontal synchronizing signals. The circuit is returned to the initial state with a vertical synchronizing signal which is inputted after all the scanning electrodes are scanned. The vertical synchronizing signal is coincidental to the refresh frequency in display and generally is determined as being 55 cycles or higher.

An example will be described below for the case wherein a plasma display panel having display cells of 640 ×400 dots is driven by the aforementioned driving method.

The applied voltage $V_0$ shown in FIG. 1A was set at 180 V, its frequency at 800 KHz. the applied voltage $V_1$ in FIGS. 1B, and 1C were set at 30 V, their frequency at 800 KHz, the period Ta at 20 micro sec., and the period $T_b$ at 10 micro sec. The period $T_c$ contains several pulses. The plasma display panel shows stable performance without erroneous discharge to obtain the following results:

| | Prior art Phase-select method | This invention method |
|---|---|---|
| Power | 40 W | 28 W |
| Brightness | 10 fL | 9.4 fL |

When the address mode at the period $T_a$ and the hold mode at the period $T_b$ have the same frequency, the power consumption will be decreased by an increase of the period $T_b$, but this inevitably entails a decrease in brightness. It is, therefore, preferable to design the period $T_b$ shorter than the period $T_a$ in view of brightness.

A description will now be given of an example which can reduce the power consumption and still increase the brightness.

FIG. 3 shows arrangement of pulse trains of the second embodiment.

Figures 3A, 3B, 3C, 3D, 3E:
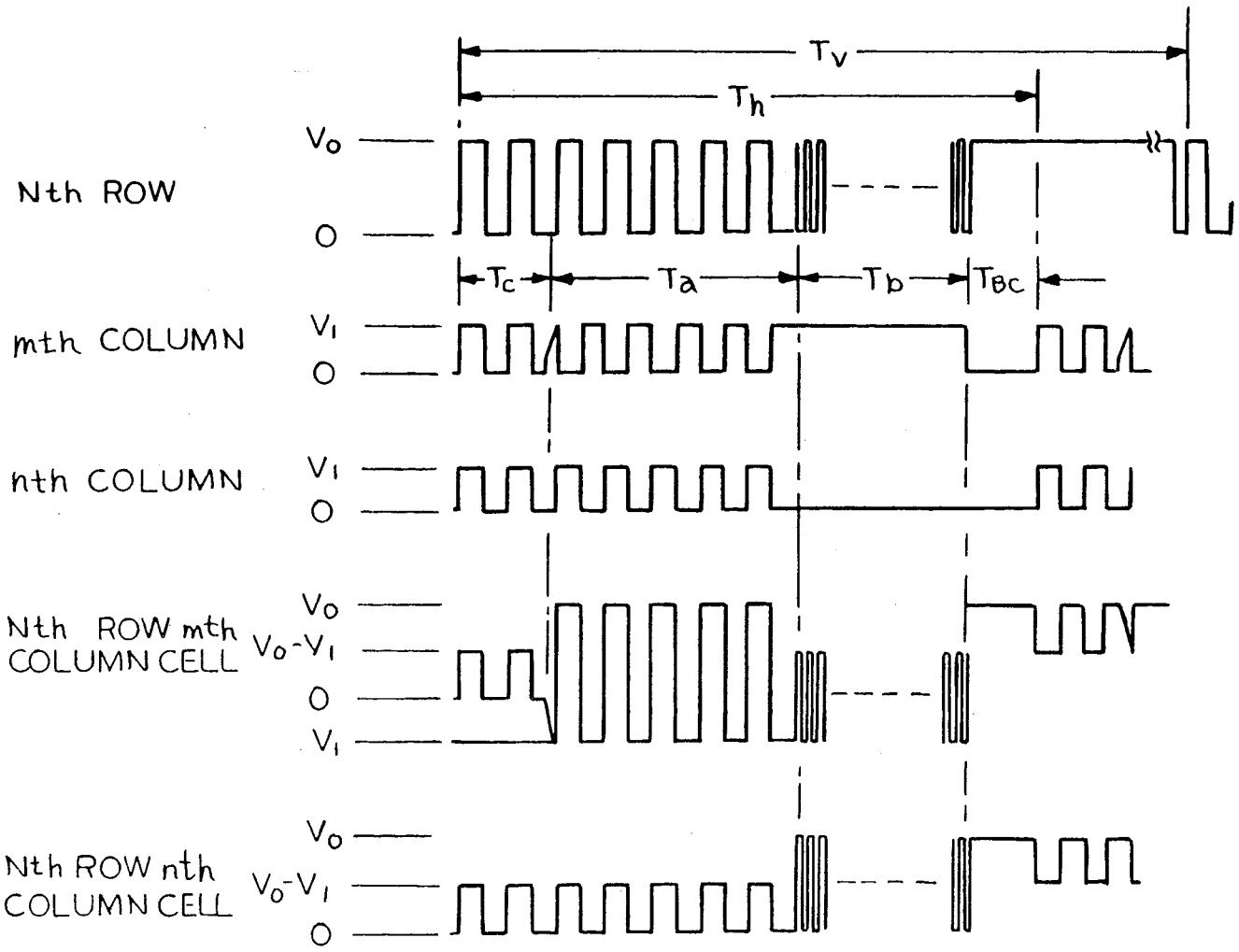
FIGS. 3A to 3E are waveform diagrams showing a relationship between the voltage applied to a scanning electrode and data electrodes, according to a second preferred embodiment of this invention.

FIG. 3A shows a pulse trains of peak voltage $V_0$ applied on the scanning electrodes at the Nth row in a plasma display panel.

FIG. 3B shows a pulse train of peak voltage $V_1$ applied on the data electrodes of the mth colunm. FIG. 3C shows the pulse train of peak voltage $V_1$ applied on the data electrodes of the nth column.

FIG 3D shows the pulsed potential difference applied on the selected (the Nth row, the mth column) cells defined at the intersections of the Nth row electrodes and the mth electrodes. FIG. 3E shows the pulsed potential difference applied on the non-selected (Nth row, the nth column) cells formed at the intersections of the Nth row electrodes and the nth colunm electrodes.

In the drawings, the period represented by the letter $T_{BL}$ *is the blanking time while the period represented by the letter Ta* is the time when a display is made in the address mode. The period represented by the letter $T_b$ is the time when a display is made in the hold mode. The period represented by the letter $T_c$ is the time when a display is made extinct. The sum of the periods, $T_a+T_b+T_c+T_{BL}$, indicates one scanning time $T_h$ where one scanning electrode is being selected.

An example where a plasma display panel having the display points of 640×400 dots is driven with the pulsed voltages shown in FIG. 3 is described below.

When the voltage $V_0$ shown in FIG. 3A was set at 170 V, the frequency in the address mode and the extinction mode at 500 KHz, the frequency in the hold mode at 2 MHZ, the voltage $V_1$ shown in FIGS. 3B and 3C at 30 V, its frequency in the address mode and the extinction mode at 500 KHz, and the frequency in the hold mode in DC, the panel showed a stable operation.

The following table shows the comparison of the power consumption and brightness of the plasma display panel driven by this invention method under the above conditions, and the plasma display panel driven by the prior art phase-select method (driven by 800 KHz).

| | Power consumption | Brightness |
|---|---|---|
| Phase-select method | 40 W | 10 fL |
| This invention method | 15 W | 12 fL |

The power consumption and brightness changed in proportion to the ratio between the time period $T_a$ in address mode and the period $T_b$ in hold mode in FIG. 3. The ratio was set at 1:2 in the above example.

In the second example, the power consumption can be reduced. At the same time, the brightness can be increased by increasing the frequency in the hold mode. The frequency during the periods $T_a$ and $T_c$ may be selected from the range of 400 KHz to 600 KHz. The frequency for the period $T_b$ may be selected from the range of 1.5 MHz to 3 MHz. It is preferable that the duration of the period $T_b$ is 1 to 2.5 times the duration of the period $T_a$. The period $T_c$ should be smaller than the periods $T_a$ and $T_b$ such that the period $T_c$ contains only several pulses so as not to disturb a display quality. Only one pulse for the extinction mode can work and it is desired that the period $T_c$ is less than half of the period $T_a$.

While the brightness can be improved by increasing the frequency in the hold mode, it is possible to apply a waveform which is substantially the same as the output waveform of the circuit to an entire region of the panel by further reducing the frequency in the periods $T_a$ and $T_c$ to be lower than the time constant formed by the stray capacitance between the column electrodes. Thus, there is obtained the effect that the operation gets stabilized. Although pulses having a smaller width are depicted in FIG. 3B after the extinction pulse, this is irrelevant to the present intension, and there is obtained the result that the driving voltage is within the same range irrespective of the existence of such narrow pulses.

FIG. 4A to FIG. 4E are a timing chart showing the voltage arrangement of the third embodiment of the present invention. This embodiment is the same as the first and second embodiments except that the hold mode is eliminated. FIG. 4A to FIG. 4E show the pulse train of peak voltage $V_0$ applied to the scanning electrode in the 1st row for one scanning period $T_h$. As shown in the drawing, the period $T_a$ is an address mode, and the period $T_c$ a extinction mode, and the period $T_{BL}$ a blanking mode. As described with reference to the first and second embodiments, since the range of the driving voltage can be expanded and enhanced in this embodiment, plasma displays that have conventionally been rejected as defective products because the initial discharge voltage of certain dots is higher than that of others by one to two volts due to variance of plasma display panels can now be used. Therefore, the production yield can be improved.

Figure 5:
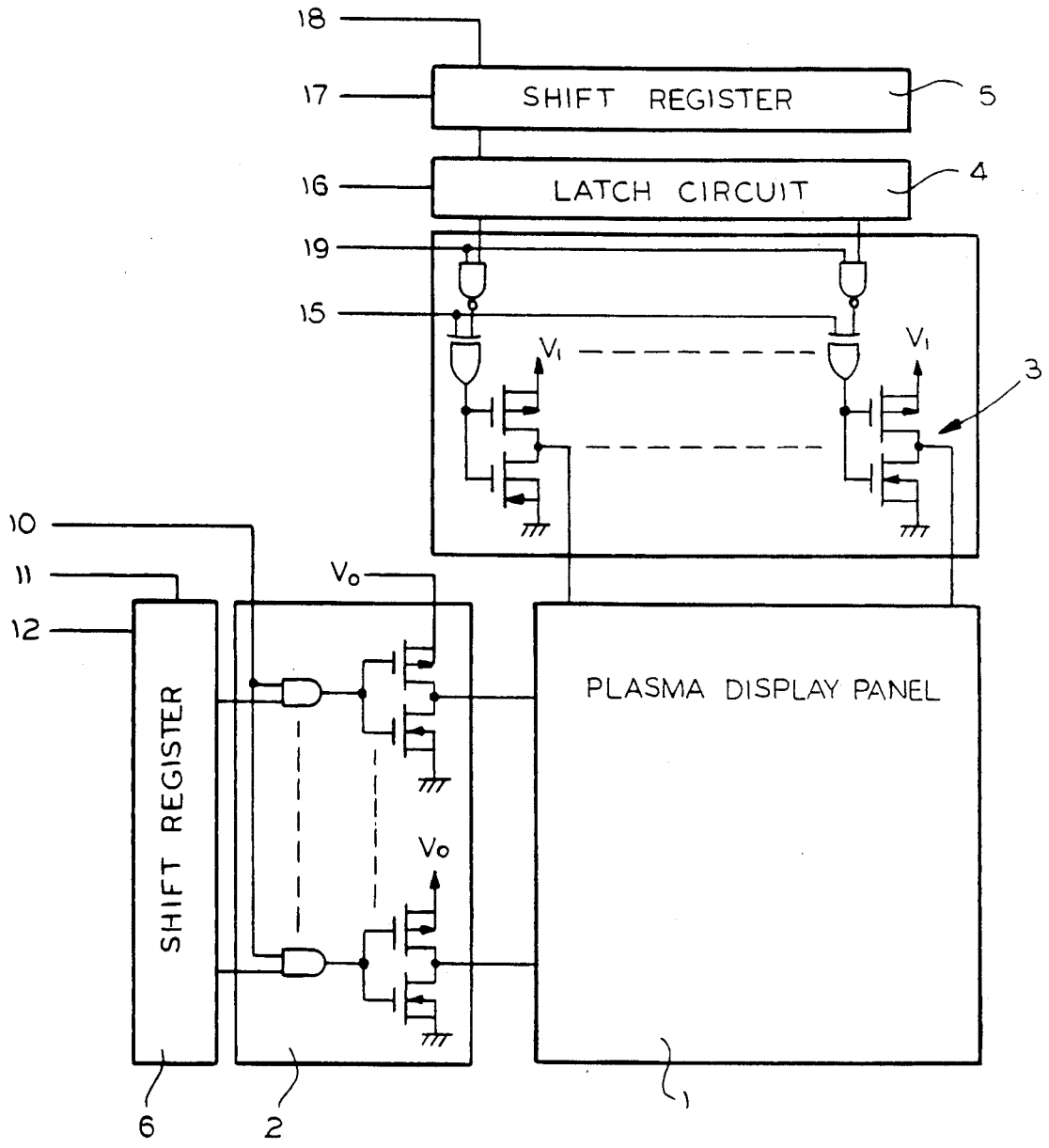
FIG. 5 is a block diagram of a driving circuit for a plasma display panel according to the first preferred embodiment of this invention.

FIG. 5 is a block diagram showing a plasma display system according to the present invention. The plasma display system comprises a matrix display type of plasma display panel 1, a driving circuit for the row electrode group 2, a driving circuit for the column electrode group 3, a latch circuit 4 for storing data, a shift register 5 for storing data temporarily, and a shift register 6 for sequentially shifting row electrodes.

The pulse train of peak voltage $V_0$ which is to be applied at row electrodes is generated by a complementary inverter circuit at the last stage of the driving circuit 2 and has the peak value of $V_0$. The input signals of this circuit 2 are the output from the shift register 6 and the high frequency pulse signal 10 which is inputted from the outside and which are mixed at an AND gate. The output signal of the AND gate is amplified upto the value of high voltage source $V_0$ by the inverter circuit. Thus, the high frequency pulse signal which is inputted from outside and the output from the driving circuit 2, at the last stage, have the same frequency of opposite phases. The shift register 6 receives scanning data signal 11 and scanning clock signal 12 as input. The scanning data signal 11 is sequentially transferred by the scanning clock signal 12 to the AND gate in the driving circuit 2.

The column electrodes driving circuit 3 comprises a complementary inverter circuit which receives the output from an exclusive OR circuit as an input which is to be inverted at the driving circuit. The data inputted at the shift register 5 via the dot data input 17 and the data shift clock signal 18 are transmitted to the latch circuit 4 by a latch pulse signal 16. Each latch output is inputted to an AND circuit in the driving circuit 3 and is mixed with a blanking signal 19 on the data side that is inputted from outside. This blanking signal is normally at a high level but when this signal is switched to a low level, the output of the NAND circuit can be fixed to the high level in the same way as when the data does not exist, irrespective of the existence of the output of the latch 4. The output of this NAND circuit is further inputted at the exclusive OR circuit in the driving circuit 3 to be mixed with the high frequency pulse signal 15 which is inputted from outside. If there is not output from the latch circuit 4, the output from the exclusive OR circuit has a phase which is opposite to the phase of the high frequency pulse signal 15 which is inputted from outside. The high frequency pulse 15 is then amplified up to the value of voltage source $V_1$, by the inverter circuit. Thus, the pulse train obtained from the column electrodes driving circuit 3 has a phase which is the same as the phase of the high frequency pulse signal 15. Conversely, if there is an output from the latch circuit 4, the output from the exclusive OR circuit has a phase which is identical to the phase of the high frequency pulse signal 15, inputted from outside. The pulse train in the output circuit has the phase opposite thereto.

The DC voltage needed for a hold mode can be obtained by converting the high frequency pulse signal 15 to a DC signal. The conversion in frequency which is necessary for the hold mode, as in the second preferred embodiment, may be conducted by switching the frequency of the high frequency pulse signal 10 that is inputted from outside.

According to the present invention, since all the discharge cells stop discharge in the short period $T_C$ of the extinction mode, pick up of discharge from the adjacent cells is eliminated, and thus the voltage which causes erroneous discharge becomes higher. Moreover, the power consumed is remarkably reduced in the period while the voltage is entirely irrelevant to the waveform applied to the scanning electrodes or while the direct current voltage is applied to the data electrodes. This reduction occurs because the power consumed between adjacent data electrodes becomes negligible.

Further the driving becomes stable with a smaller power consumption in this inventive circuit by lowering driving frequency for the period of driving which is similar to the phase-select method, and by increasing the frequency of the period when DC voltage is being applied to data electrodes. In the foregoing description, the extinction mode is separated from the blanking period, but the extinction mode may be located in the blanking period.

What is claimed is:

1. A plasma display apparatus comprising a first electrode group and a second electrode group disposed in an opposed relationship relative to each other, the space intermediary of the opposed electrode groups being filled with a discharge gas to form cells therebetween, the plasma display comprising:

first means for applying a first pulse train of a first voltage to said first electrode group for a first period at a predetermined interval in a time division mode;

second means for applying a second pulse train of a second voltage to at least one selected electrode in said second electrode group for a second period which is shorter than said first period, said second pulse train being applied in synchronism and in combination with said first pulse train so as to produce a first pulsing potential difference between the electrodes associated with a selected cell, a phase of said second pulse train being opposite to a phase of said first pulse train such that said first pulsing potential difference is larger than a firing voltage of said cell;

third means for applying to non-selected electrodes in said second electrode group and during said second period a third pulse train of third voltage pulses in synchronism with said first pulse train so as to produce a second pulsing potential difference between the electrodes associated with non-selected cells in combination with said first pulse train, a phase of said third pulse train being identical to the phase of said first pulse train such that said second pulsing potential difference is less than the firing voltage of said cell; and fourth means for applying a fourth pulse train of a fourth voltage pulses to all of said second electrodes for a third period which is shorter than said second period, said third period being within said first period but before the application of said second pulse train and said third pulse train so as to produce a third pulsing potential difference between the electrodes associated with said selected cell and non-selected cells, a phase of said fourth pulse train being identical to the phase of said first pulse train such that said third potential difference is smaller than the firing voltage of said cell.

2. The apparatus of claim 1, further comprising fifth means for applying a first direct-current voltage component in combination with said first pulse train to said at least one selected electrode in said second electrode group during a fourth period which is shorter than said first period, said fourth period being after the application of said second voltage pulses so as to produce a fourth pulsing potential difference between the electrodes associated with said selected cell, said fourth pulsing potential difference being smaller than the firing voltage of said cell, but also being enough larger to continue the discharge of said selected cell due to a previously discharging state of said selected cell, and sixth means for applying a second direct-current voltage component in combination with said first pulse train to said non-selected electrodes in said second electrode group for said fourth period after the application of said third pulse train so as to produce a fifth pulsing potential difference between the electrodes associated with said non-selected cells, said fifth pulsing potential difference being less than the firing voltage of said cell, the period of applying said fifth pulsing potential difference being smaller than the period required to cause a discharge of said non-selected cells.

3. The apparatus of claim 2, wherein said first pulse train includes a first pulse train portion having pulses of a first frequency and continuing for said second period, and a second pulse train portion having pulses of a second frequency which is higher than said first frequency and continuing for said fourth period.

4. The apparatus of claim 2, wherein the amplitude of said second pulse train is the same as the amplitude of said third pulse train and said fourth pulse train.

5. A plasma display apparatus comprising a first electrode group and a second electrode group disposed in an opposed relationship relative to each other, the space intermediary of the opposed electrode groups being filled with a discharge gas to form cells therebetween, the plasma display comprising:

first means for applying a first pulse train of a first voltage to said first electrode group for a first period at a predetermined interval in a time division mode;

second means for applying a second pulse train of a second voltage to at least one selected electrode in said second electrode group for a second period which is shorter than said first period, a phase of said second pulse train being opposite to a phase of said first pulse train so as to produce a first pulsing potential difference between the electrodes associated with a selected cell, said first pulsing potential difference being larger than a firing voltage of said cell;

third means for applying a third pulse train of third voltage pulses to non-selected electrodes in said second electrode group and during said second period, a phase of said third pulse train being identical to a phase of said first pulse train so as to produce a second pulsing potential difference between the electrodes associated with non-selected cells in combination with said first pulse train, said second pulsing potential difference being less than the firing voltage of said cell, fourth means for applying a fourth pulse train of fourth voltage pulses to all of said second electrodes for a third period which is shorter that said second period, said third period being within said first period before the application of said second pulse train and said third pulse train, a phase of said fourth pulse train being identical to the phase of said first pulse train so as to produce a third pulsing potential difference between the electrodes associated with said selected cell and non-selected cells, said third potential difference being smaller than the firing voltage of said cell, fifth means for applying a first direct-current voltage component in combination with said first pulse train to said at least one selected electrode in said second electrode group during a fourth period which is shorter than said first period, said fourth period being after the application of said second voltage pulses so as to produce a fourth pulsing potential difference between the electrodes associated with said selected cell, said fourth pulsing potential difference being smaller than the firing voltage of said cell, but also being enough larger to continue the discharge of said selected cell due to a previously discharging state of said selected cell, and sixth means for applying a second direct-current voltage component in combination with said first pulse train to said non-selected electrodes in said second electrode group for said fourth period after the application of said third pulse train so as to produce a fifth pulsing potential difference between the electrodes associated with said non-selected cells, said fifth pulsing potential difference being less than the firing voltage of said cell, the period of applying said fifth pulsing potential difference being smaller than the period required to cause a discharge of said non-selected cells.

* * * * *